US008937519B2

(12) United States Patent
Gerving et al.

(10) Patent No.: US 8,937,519 B2
(45) Date of Patent: Jan. 20, 2015

(54) CONTACTOR FOR DC OPERATION

(75) Inventors: Karsten Gerving, Bonn (DE); Ralf Thar, St. Augustin (DE); Johannes Meissner, Bonn (DE); Volker Lang, Bonn (DE)

(73) Assignee: Eaton Electrical IP GmbH & Co. KG, Schoenefeld (DE)

( * ) Notice: Subject to any disclaimer, the term of this patent is extended or adjusted under 35 U.S.C. 154(b) by 0 days.

(21) Appl. No.: 14/235,485

(22) PCT Filed: Jul. 27, 2012

(86) PCT No.: PCT/EP2012/064809

§ 371 (c)(1),
(2), (4) Date: Jan. 28, 2014

(87) PCT Pub. No.: WO2013/014281

PCT Pub. Date: Jan. 31, 2013

(65) Prior Publication Data

US 2014/0151338 A1 Jun. 5, 2014

(30) Foreign Application Priority Data

Jul. 28, 2011 (EP) ..... 11175847

(51) Int. Cl.

| | |
|---|---|
| ***H01H 9/30*** | (2006.01) |
| ***H01H 33/18*** | (2006.01) |
| ***H01H 1/20*** | (2006.01) |
| ***H01H 9/36*** | (2006.01) |
| ***H01H 9/44*** | (2006.01) |

(52) U.S. Cl.

CPC ..... *H01H 33/182* (2013.01); *H01H 1/20* (2013.01); *H01H 9/36* (2013.01); *H01H 9/443* (2013.01); *H01H 1/2066* (2013.01)

USPC ..... 335/201; 335/160; 335/132

(58) Field of Classification Search

USPC ..... 335/132, 160, 201

See application file for complete search history.

(56) References Cited

U.S. PATENT DOCUMENTS

| | | | | | |
|---|---|---|---|---|---|
| 3,354,415 | A | * | 11/1967 | Gribble et al. | 335/131 |
| 3,506,937 | A | * | 4/1970 | Hanafusa | 335/16 |
| 3,643,187 | A | * | 2/1972 | Stallman et al. | 335/132 |
| 3,944,953 | A | * | 3/1976 | Oster | 335/23 |

(Continued)

FOREIGN PATENT DOCUMENTS

| | | | |
|---|---|---|---|
| DE | 10212948 | B4 | 11/2002 |
| DE | 102006035844 | B4 | 2/2008 |

(Continued)

*Primary Examiner* — Truc Nguyen

(74) *Attorney, Agent, or Firm* — Leydig, Voit & Mayer, Ltd.

(57) ABSTRACT

A contactor for DC operation includes a first and a second contact that are fixed contacts and a contact bridge that has a third and a fourth contact. The contact bridge, in a closed position, provides a tactile contact between a first contact pair, which comprises the first and the third contact, and between a second contact pair, which comprises the second and the fourth contact. The contact bridge is movable via a guide along a direction of movement. A magnet arrangement is configured to generate an electromagnetic force on an electric arc, which arises on opening the contacts. The contact bridge has at least one recess, which is arranged between the guide and the third contact. The recess is configured to provide an opening at the contact bridge through which the arc, generated at the third contact, is deflected in the direction of movement of the contact bridge.

16 Claims, 6 Drawing Sheets

(56) References Cited

U.S. PATENT DOCUMENTS

| | | | | |
|---|---|---|---|---|
| 4,490,903 | A * | 1/1985 | Agatahama | 29/622 |
| 5,004,874 | A | 4/1991 | Theisen et al. | |
| 5,864,453 | A * | 1/1999 | Wieloch et al. | 361/14 |
| 6,366,186 | B1 * | 4/2002 | Hill et al. | 335/78 |
| 8,274,347 | B2 * | 9/2012 | Eum | 335/201 |
| 8,395,463 | B2 * | 3/2013 | Ito et al. | 335/78 |
| 2004/0027775 | A1 * | 2/2004 | Lang | 361/160 |
| 2008/0030289 | A1 | 2/2008 | Kralik | |
| 2009/0127229 | A1 | 5/2009 | Schmitz et al. | |

FOREIGN PATENT DOCUMENTS

| | | | |
|---|---|---|---|
| EP | 0473013 | A2 | 3/1992 |
| EP | 2061053 | A2 | 5/2009 |

* cited by examiner

CONTACTOR FOR DC OPERATION

CROSS-REFERENCE TO PRIOR APPLICATIONS

This application is a U.S. National Phase Application under 35 U.S.C. §371 of International Application No. PCT/EP2012/064809, filed on Jul. 27, 2012, and claims benefit to European Patent Application No. EP 11175847.0, filed on Jul. 28, 2011. The International Application was published in German on Jan. 31, 2013 as WO 2013/014281 under PCT Article 21(2).

FIELD

The invention concerns a contactor for DC operation comprising a first and a second contact designed as fixed contacts as well as a third and a fourth contacts, which are arranged on a contact bridge. In addition, the contactor comprises a guide through which the contact bridge is movably positioned along a direction of movement, and a magnet arrangement for generating electromagnetic force on electric arcs. The first and third contact and the second and fourth contact each form contact pairs, between which there is tactile contact if the contact bridge is in a closed position.

BACKGROUND

In particular, opening the contacts can lead to an electric arc, that is, sparking along with gas discharge. The appearance of arcs during the switching operation has negative effects on the contactor. The arc leads to the flow of electricity between the contacts continuing even after spatial separation of the contact surfaces in question, thus increasing the switching time. Furthermore, the electric discharge in the arc releases a relatively large amount of heat, which leads to undesirable heating up of the contactor. In particular, the heating causes a high wear ("burning off") of the contacts, if the arc persists over an extended period at the point of the contacts. This eventually leads to the life of the contactor being reduced. In contactors with the so-called double break feature, an arc generally appears on both the contact pairs.

To solve the aforementioned problems, appropriate permanent magnets and arc quenchers are normally used in DC applications. The permanent magnets are arranged near the contact pairs. Each of them generates a magnetic field, which at an appropriate polarity generates a force on the respective arc, which is usually referred to as "magnetic blowout".

This force will deflect the arcs in the direction of the arc quenchers arranged next to the contact pairs similar to quenching chambers.

For unidirectional operation, the permanent magnets can have the same polarity. In such an arrangement and when used properly, both arcs will be deflected one each into the two quenching chambers. However, if the contactor is connected with an incorrect polarity, both the arcs will be deflected by the blowout fields not into the quenching chambers, but in the correspondingly opposite direction, which could lead to them persisting for too long at a given point and thus giving rise to the aforementioned negative effects.

If the contactor needs to be operated bidirectionally, the permanent magnets usually have opposite polarities. Due to the current flow being in the opposite direction, both the arcs are thus deflected in the same direction. This ensures that irrespective of polarity, one arc is always deflected towards the quenching chamber, while the other is deflected away from the quenching chambers. Accordingly, appropriate measures also need to be taken here in order to prevent the negative effects caused by one of the arcs.

DE 10 2006 035 844 B4 describes a contactor for DC and AC operations, which, in addition to the two permanent magnets with opposite polarities, also comprises two blowout coils. The blowout coils are activated only if one of the arcs, deflected by the magnetic field of one of the permanent magnets, passes over to a suitably arranged baffle plate. Due to the effect of the coil's magnetic field, the arc is then guided in the direction of a quencher. The disadvantages in such an arrangement are the increased requirement of space for the additional quencher in the contacts, the heating caused by the current flow in the coil and last but not least, the increased manufacturing cost of the contactor due to additional coils being used.

DE 102 12 948 B4 describes a contactor for AC and DC operation, in which the contact bridge has a sharp-edged groove running transversely to the blow direction and located on the side away from the blow direction. If an arc is deflected away from the quenching chamber, the design of the groove prevents further deflection of the arc, which remains caught on the edge of the groove. When the direction of current flow is reversed in AC operation, the arc will only be deflected into one quenching chamber. The disadvantage here is that during DC operation, the arc in the aforementioned case remains in contact with the middle portion of the contact bridge for a relatively long time.

SUMMARY

In an embodiment, the present invention provides a contactor for DC operation including a first and a second contact that are fixed contacts and a contact bridge that has a third and a fourth contact. The contact bridge, in a closed position, provides a tactile contact between a first contact pair, which comprises the first and the third contact, and between a second contact pair, which comprises the second and the fourth contact. The contact bridge is movable via a guide along a direction of movement. A magnet arrangement is configured to generate an electromagnetic force on an electric arc, which arises on opening the contacts. The contact bridge has at least one recess, which is arranged between the guide and the third contact. The recess is configured to provide an opening at the contact bridge through which the arc, generated at the third contact, is deflected in the direction of movement of the contact bridge.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
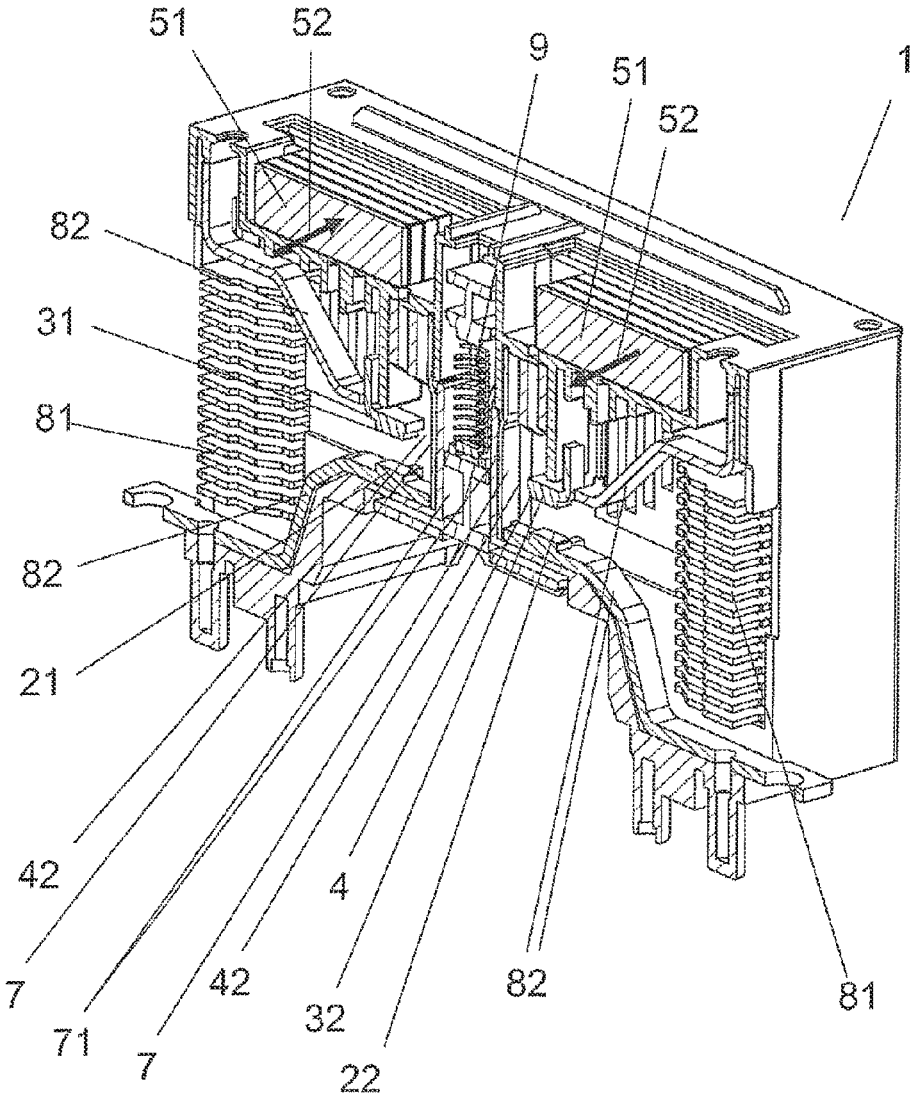
FIG. 1 shows a partial perspective view of one of the contactors according to the invention in the open position of the contacts.

In an embodiment, the present invention provides an improved contactor for bidirectional DC operation.

The contactor according to and embodiment of the invention is distinguished by the movable contact bridge having at least one recess arranged between the guide and the third contact, whereby at least one recess is designed such that an opening is present on the contact bridge, through which the arc generated at the third contact can flow from in the direction of the contact bridge's movement. This opening allows arcs blown by the magnetic field up to the guide to escape.

A similar recess can also be arranged between the guide and the fourth contact. This additional recess can be identical in design and spatial arrangement to the recess between the guide and the third contact. The following designs of the latter recess are thus also applicable to the recess between the guide and the fourth contact.

In a preferred design, the contactor according to the invention also has permanent magnets and arc quenchers allocated to each contact pair. Both the magnets are advantageously of opposite polarity. If arcs arise when opening the contacts, an arc is always deflected through the magnetic field of one of the magnets in the direction of the associated quenching chamber irrespective of the direction of current in the contactor. On the other hand, the other arc moves towards the guide of the contact bridge. The recess thus prevents the arc from causing damage to the guide. Rather, the arc is deflected through the recess using appropriate baffle plates and away from the contacts. In this manner, damage to the materials in the region of the contacts and the guide of the contact bridge is avoided.

Preferably, at least one of the permanent magnets is provided with a pair of pole plates, which at least partially enclose the contact pair to which the permanent magnet is allocated. The pole plates ensure a relatively homogeneous magnetic field in the region of the contacts, which further strengthens the force on the arcs. Here too, the other permanent magnet can accordingly be provided with pole plates as well.

In a preferred design example, the contact bridge comprises an essentially strip-type base body with an upper side, a lower side, two long sides as well as two short sides. Here, the contact bridge can be made of a plate strip.

According to a preferred design example, at least one of the recesses in the contact bridge is designed in the form of an indentation that is open to one of the long sides of the contact bridge. This indentation forms a space that is accessible from the upper side, the lower side as well as from one of the long sides of the contact bridge.

According to a design example, the contact bridge comprises the said two recesses, each in the form of indentations, whereby the recesses can be open to the same long side of the contact bridge or to the facing long side of the contact bridge. The at least one recess in the contact bridge can be L-shaped.

Preferably, the contact bridge has on at least one of its short sides an appendage that has an angle to the base body of the contact bridge. Accordingly, the other short side can also have an appendage that can be fully or somewhat identical in form and arrangement to the aforementioned appendage.

The appendage essentially extends away from the fixed contacts and can serve to guide the arcs in the direction of appropriate arc quenchers. Preferably, the appendage is essentially vertical to the base body of the contact bridge. In such a case, the appendage and base body are at an angle of 90°. The appendage can also be designed such that it extends essentially parallel to the base body. In such a case, the appendage and base body form two U-legs separated from one another. The angle in case of a U-shaped arrangement of the appendage is then 180°. Depending on the contactor, the angle may also be between 90° and 180°, for instance, 120 or 150°.

In the region of the recess, the cross section of the contact bridge is reduced. In order to reduce the increased electrical resistance in the region thus caused, the contact bridge preferably has an expansion or an expanded section. The expansions can, for instance, be designed as additional angulations that are formed on one of the long sides of the base body.

Between the guide of the contact bridge and the third contact, a first baffle plate can be arranged, which engages at least partially with at least one recess of the contact bridge. The contactor can have another, second baffle plate that engages with the other recess of the contact bridge. In such a case, the first baffle plate is arranged between the guide of the contact bridge and the third contact, while the second baffle plate is arranged between the guide of the contact bridge and the fourth contact. If the polarity of the arrangement of magnets is appropriate, one of the arcs can be guided over one of the baffle plates away from the contact allocated to this baffle plate. The baffle plates can be designed integrally with the fixed contacts.

According to another preferred design, the first baffle plate comprises an angulated section. Here, the angulated section is preferably at an essentially right angle to the rest of the baffle plate.

Preferably, the contactor according to the invention comprises a first separator that is arranged between the guide of the contact bridge and the third contact, preferably between the guide of the contact bridge and the first baffle plate. The first separator engages with the at least one recess on the contact bridge, at least partially. It is made of an insulating material, such as ceramic or plastic and serves as additional protection against damage caused by any of the arcs. The contactor can have another, second separator that is arranged between the guide of the contact bridge and the fourth contact and engages with the other recess on the contact bridge.

Another preferred design of the invention provides for a quenching chamber arranged next to each of the contact pairs. At least one of the arcs can thus be guided by the magnetic field of one of the permanent magnets with appropriate polarity into one of the quenching chambers. In addition, arc baffle plates are arranged between each of the contact pairs and the neighbouring quenching chamber. The arc baffle plates are designed such that the gap between baffle plates that lead to the same quenching chamber increases in the direction of this quenching chamber.

FIG. 1 shows a partial perspective view of a contactor 1 according to the invention. The contactor 1 comprises a first contact 21 and a second contact 22, a third contact 31 and a fourth contact 32. The first contact 21 and the second contact 22 are designed as fixed contacts. The third contact 31 and the fourth contact 32 are arranged on a contact bridge 4. The contact bridge 4 is movably positioned on a guide 9. The contact bridge 4 can be moved due to its movable position between a closed position, in which a tactile contact is provided between a first contact pair comprising the first contact 21 and the third contact 31, as well as a second contact pair, comprising the second contact 22 and the fourth contact 32, and an open position. In the open position, no tactile contact is present between the first contact 21 and the third contact 31 as well as the second contact 22 and the fourth contact 32. The contact bridge 4 is shown in open position in FIG. 1.

In addition, the contactor 1 comprises a magnet arrangement comprising two permanent magnets 51, which have opposite polarity. The direction of the magnetic fields is indicated by the arrow 52.

The contact bridge 4 comprises two recesses 42, each of which is arranged between one of the contacts 31, 32 and the guide 9 of the contact bridge (a detailed description of the contact bridge is provided below under the description of FIGS. 3 and 4). In addition, the contactor 1 comprises 2 baffle plates 7, each of which is arranged between one of the contacts 31, 32 and the guide 9 of the contact bridge. Each of the two baffle plates 7 engages with one of the recesses 42. Next to the baffle plates 7, insulating separators 71 are arranged on the side of the baffle plates facing the guide 9 of the contact bridge 4; each of the insulating separators 71 engage partially with one of the recesses 42.

In addition, the contactor 1 comprises two quenching chambers 81 and arc baffle plates 82. The arc baffle plates 82 are designed such that the gap between the baffle plates 82 that lead to the same quenching chamber 81 increases in the direction of this quenching chamber. The magnetic fields of the permanent magnets 51 generate a force on each of the arcs that arise on opening the contacts.

The opposite polarity of the permanent magnets will always deflect one of the arcs away from the contacts, over the arc baffle plates 82 into an arc quencher 81, where it can be quenched.

Figure 2A:
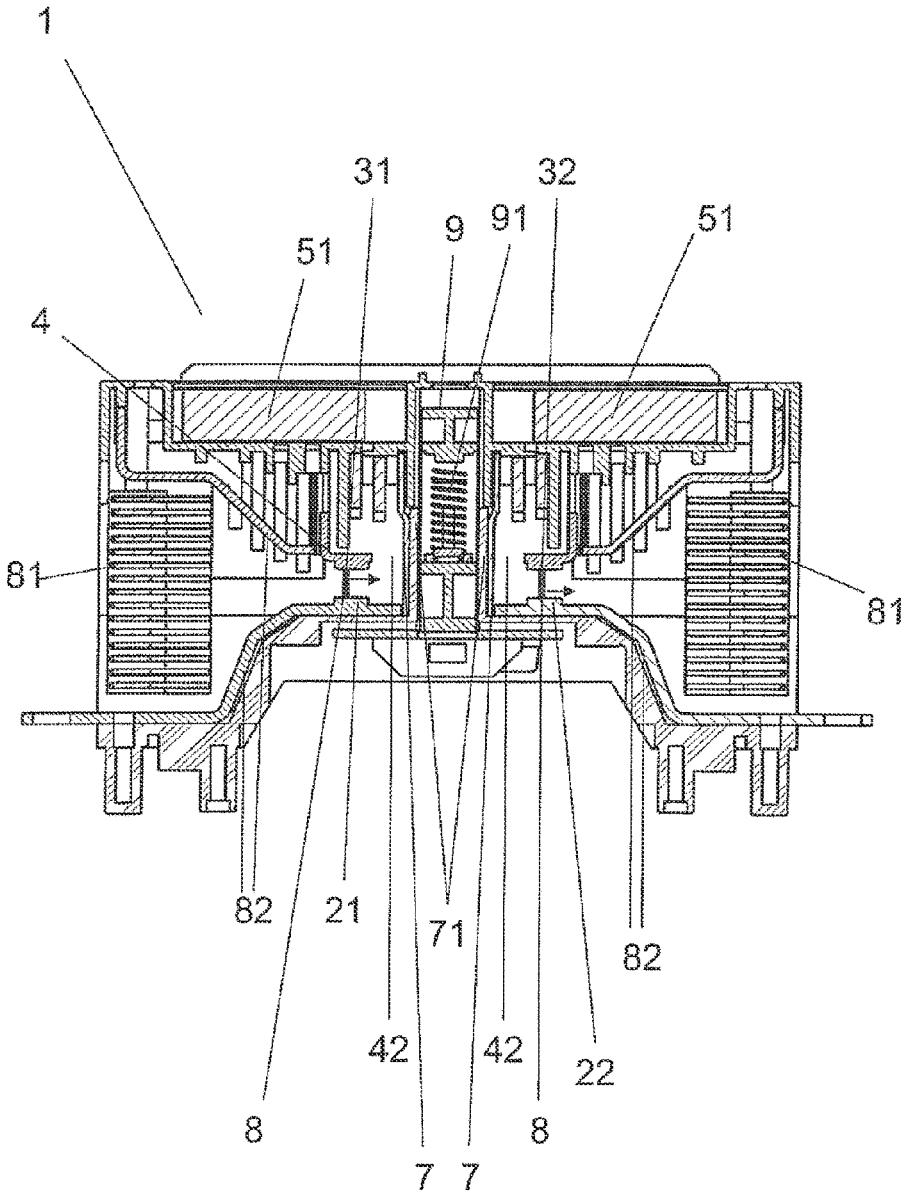
FIG. 2*a* shows a side view of the contactor in FIG. 1 in its longitudinal section.

FIG. 2*a* shows the longitudinal section of a side view of the contactor 1. With regard to the individual components and features, refer to the description under FIG. 1. The magnetic fields of the permanent magnets 51 generate a force on each of the arcs 8 generated when the contacts are opened. The arcs 8 are only shown schematically in FIG. 2*a*. The direction of the force is outlined in FIG. 2*a* by a vector arrow based on the arc. The opposite polarity of the permanent magnets will always deflect one of the arcs 8 away from the contacts, over the arc baffle plates 82 into an arc quencher 81, where it can be quenched.

FIG. 2*a* shows the longitudinal section of a side view of the contactor 1. With regard to the individual components and features, refer to the description under FIG. 1. The magnetic fields of the permanent magnets 51 generate a force on each of the arcs 8 generated when the contacts are opened. The arcs 8 are only shown schematically in FIG. 2*a*. The direction of the force is outlined in FIG. 2*a* by a vector arrow based on the arc. The opposite polarity of the permanent magnets will always deflect one of the arcs 8 away from the contacts, over the arc baffle plates 82 into an arc quencher 81, where it can be quenched. The other arc 8 is however deflected in the direction of the guide 9 of the contact bridge 4.

Figure 2B:
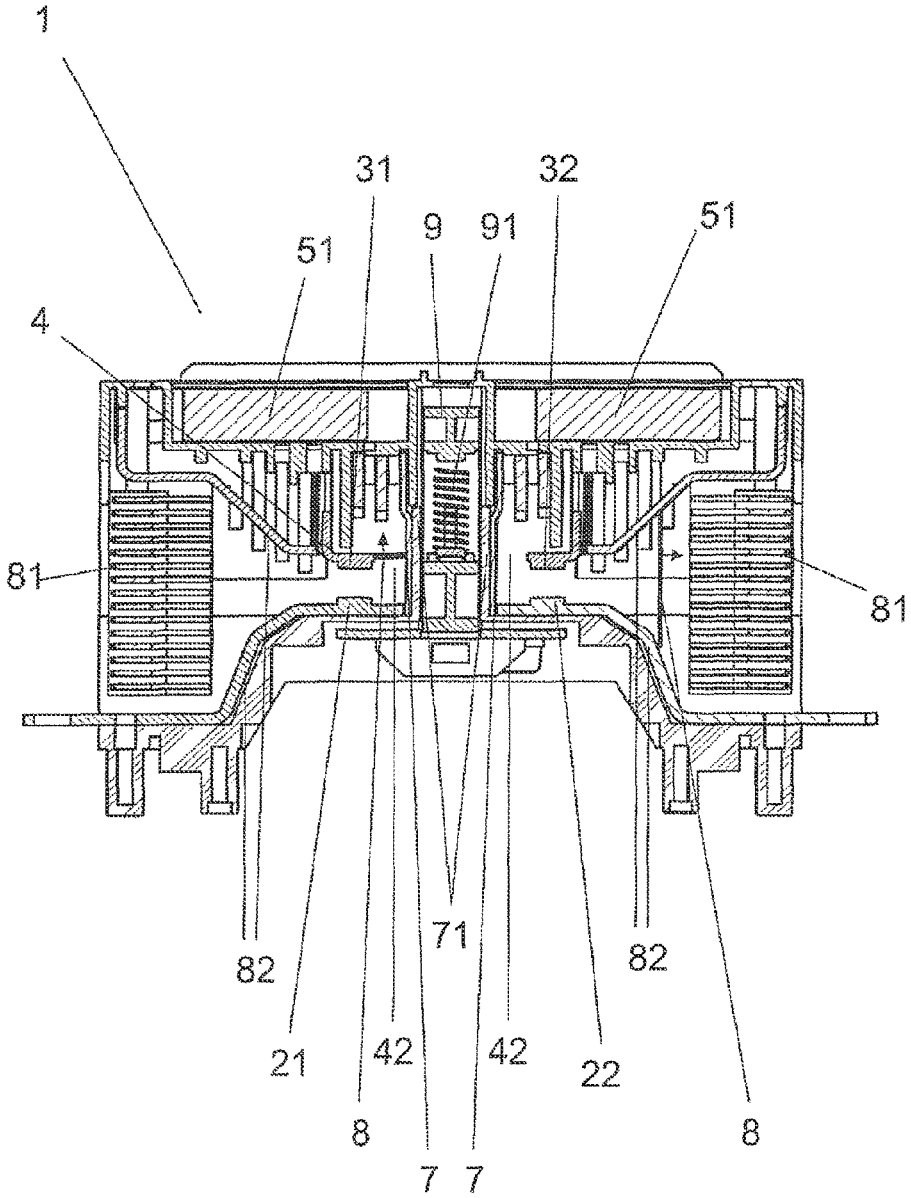
FIG. 2*b* shows another side view of the contactor in FIG. 1 in its longitudinal section.

FIG. 2*b* shows the contactor 1 according to FIG. 2*a*, but at a later time. Due to the arrangement of the arc baffle plates 82 that extend in the direction of the quenching chamber 81, the arc 8 now located in the vicinity of the quenching chamber 81 is also extended, which also contributes to its cooling. The other arc 8 is still deflected away from the third contact 31 by the guide 42 and over the baffle plate 7. Optionally, arc quenching baffles 83 can be arranged over the contact bridge 4, such that the arc 8 that is deflected away can ultimately be deflected between the quenching baffles 83 and extinguished there.

Figure 3:
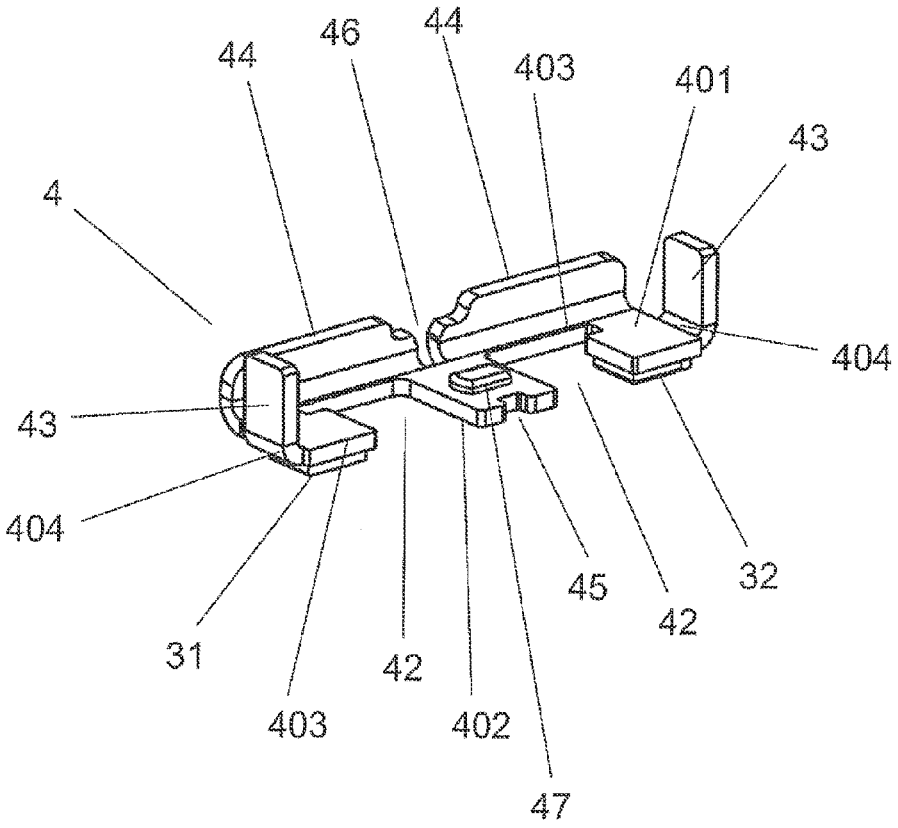
FIG. 3 shows a perspective view of a contact bridge.
Figure 4:
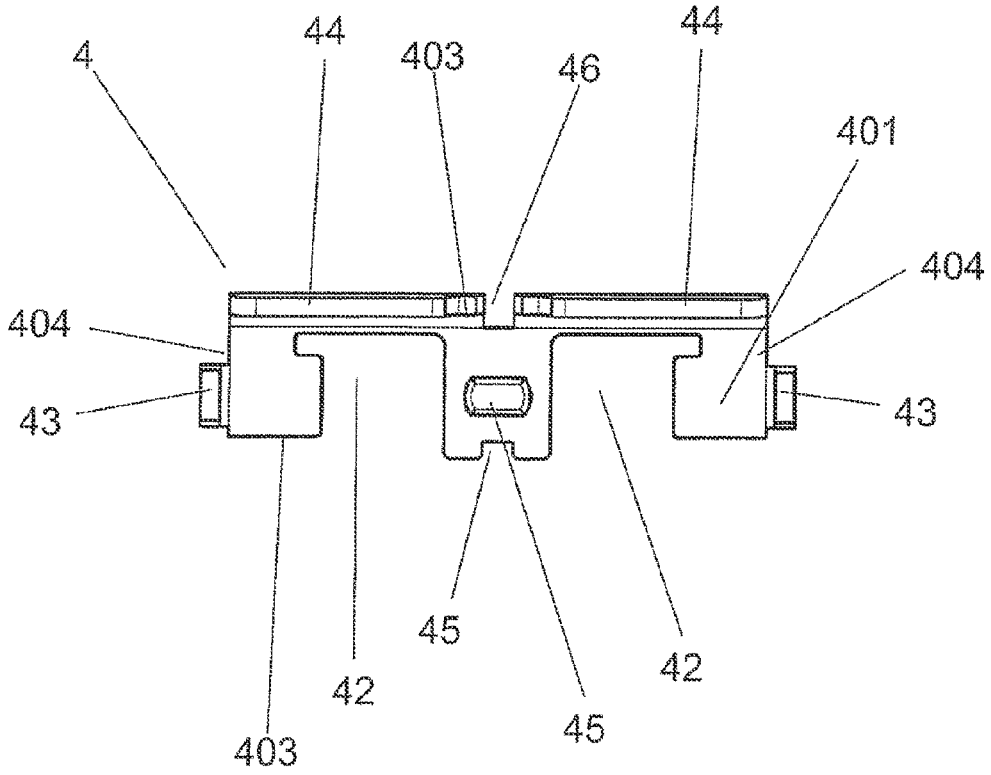
FIG. 4 shows a top view of the contact bridge in FIG. 3.

FIG. 3 shows a perspective diagram of the contact bridge 4. FIG. 4 shows a top view of the contact bridge. The contact bridge 4 has an essentially strip-type base form with an upper side 401, a lower side 402, two long sides 403 and two short sides 404. The third contact 31 and the fourth contact 32 are located on the lower side of the contact bridge 4.

The middle of the contact bridge 4 has two slits 45 and 46 that interact with the guide. Furthermore, the recess has an elevation 47, through which the position of one end of a spring 91 can be fixed. The contact bridge 4 comprises the two recesses 42 that are designed in the form of indentations. Both the recesses 42 are open to one long side 403 of the contact bridge 4. In addition, both the recesses 42 are L-shaped when viewed from above (FIG. 4).

The recesses 42 are designed such that movement of an arc 8 (FIG. 2*a*, 2*b*) along the contact bridge 4 over a direct path between one of the contacts 31, 32 and the elevation 47 is interrupted. If, for instance, an arc arises at the third contact 31, it is initially deflected by the effect of the permanent magnets 51 (FIG. 1) along the contact bridge 4 in the direction of the elevation 47. Its movement in the direction of the elevation 47 is however stopped at the recess 42 and the arc 8 can be deflected in the direction of the movement of the contact bridge 4. In this manner, the arc 8 is unable to reach the guide 9 (FIG. 1).

Furthermore, the contact bridge has appendages 43 on its short sides 404. The appendages essentially extend away from the third contact 31 or the fourth contact 32 and form an essentially right angle with the base body of the contact bridge 4. In the region of the recesses 42, the contact bridge 4 has expanded section 44 along one of the long sides 403, which serve to increase the cross section of the contact bridge 4. Thus, the contact bridge has sufficient cross section despite the recesses 42 in order to be able to guide current without considerable resistance between the contacts 31, 32.

Figure 5:
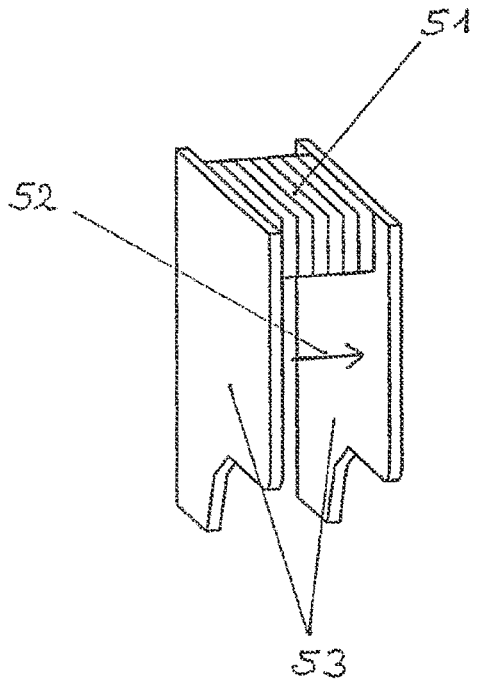
FIG. 5 shows a partial perspective view of a magnet arrangement.

FIG. 5 shows a schematic representation of a magnetic arrangement of the contactor 1 according to the invention from FIGS. 1 and 2*a*-*b* with a permanent magnet 51 and two pole plates 53. The permanent magnet 51 and the pole plates 53 generate a magnetic field whose direction is indicated by the arrows 52. A contact pair comprising the first and the third contact or the second and the fourth contact is preferably arranged between the two pole plates 53.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Reference List

1 Contactor
21,22 First contact, second contact
31,32 Third contact, fourth contact
4 Contact bridge
42 Recess
43 Appendage on the contact bridge
44 Expanded section
45,46 Slit
47 Elevation
401 Upper side of the contact bridge
402 Lower side of the contact bridge
403 Long side of the contact bridge
404 Short side of the contact bridge
5 Magnet arrangement
51 Permanent magnet
52 Direction of magnetic field
53 Pole plate
7 Baffle plate
71 Separator
8 Arc with force vector
81 Quenching chamber
82 Arc baffle plates
83 Arc quenching plates
9 Guide of the contact bridge
91 Spring

The invention claimed is:

1. A contactor for DC operation, comprising:

a first contact and a second contact that are fixed contacts;

a contact bridge that has a third contact and a fourth contact, the contact bridge, in a closed position, providing a tactile contact between a first contact pair, which comprises the first and the third contact, and between a second contact pair, which comprises the second and the fourth contact;

a guide through which the contact bridge is movably positioned along a direction of movement; and a magnet arrangement configured to generate an electromagnetic force on an electric arc, which arises on opening the contacts, wherein the contact bridge has at least one recess, which is arranged between the guide and the third contact, the recess being configured to provide an opening at the contact bridge through which the arc, generated at the third contact, is deflected in the direction of movement of the contact bridge.

2. The contactor according to claim 1, wherein the magnet arrangement comprises a first and a second permanent magnet having opposite polarity to each other, the first permanent magnet being allocated and arranged adjacent to the first contact pair and the second permanent magnet being allocated and arranged adjacent to to the second contact pair.

3. The contactor according to claim 2, wherein at least one of the permanent magnets has a pair of pole plates, which at least partially enclose the contact pair to which the permanent magnet s allocated.

4. The contactor according to claim 1, wherein the contact bridge has a strip-type base body with an upper side, a lower side, two long sides and two short sides.

5. The contactor according to claim 4, wherein the at least one recess has a form of an indentation that is open to one of the long sides of the base body of the contact bridge.

6. The contactor according to claim 5, wherein the contact bridge has two recesses which are indentations open to a same long side or to a facing long side of the contact bridge.

7. The contactor according to claim 4, wherein the contact bridge has an appendage on at least one of the two short sides, which is at an angle to the base body.

8. The contactor according to claim 7, wherein the angle between the appendage and the base body is essentially 90°.

9. The contactor according to claim 7, wherein the angle between the appendage and the base body is essentially 180°.

10. The contactor according to claim 1, wherein the contact bridge has at least one expanded section in a region of the at least one recess, which increases a cross section of the contact bridge.

11. The contactor according to claim 1, wherein the at least one recess is L-shaped.

12. The contactor according to claim 1, further comprising a baffle plate arranged between the guide and the third contact and configured to engage at least partially with the at least one recess.

13. The contactor according to claim 12, wherein the baffle plate has an essentially right-angled section.

14. The contactor according to claim 1, further comprising an insulating separator arranged between the guide and the third contact and configured to engage at least partially with the at least one recess.

15. The contactor according to claim 1, further comprising an arc chamber arranged adjacent to each of the two contact pairs.

16. The contactor according to claim 15, further comprising first arc baffle plates arranged between the first contact pair and a first neighboring quenching chamber, and second are baffle plates arranged between the second contact pair and a second neighboring quenching chamber, the arc baffle plates being configured to guide one of two arcs in a direction of a respective one of the quenching chambers based on a polarity of the magnet arrangement, a first gap between the first arc baffle plates increasing toward the first quenching chamber and a second gap between the second arc baffle plates increasing toward the second quenching chamber.

* * * * *